United States Patent [19]

Lopez

[11] 4,321,605

[45] Mar. 23, 1982

[54] ARRAY ANTENNA SYSTEM

[75] Inventor: Alfred R. Lopez, Commack, N.Y.

[73] Assignee: Hazeltine Corporation, Greenlawn, N.Y.

[21] Appl. No.: 116,735

[22] Filed: Jan. 29, 1980

[51] Int. Cl.[3] ..... H01Q 21/08; H01Q 3/30

[52] U.S. Cl. ..... 343/844; 343/854

[58] Field of Search ..... 343/754, 854, 853, 844

[56] References Cited

U.S. PATENT DOCUMENTS

| | | | |
|---|---|---|---|
| 3,056,961 | 10/1962 | Mitchell | 343/854 |
| 3,293,648 | 12/1966 | Kuhn | 343/854 |
| 3,295,134 | 12/1966 | Lowe | 343/854 |
| 4,168,503 | 9/1979 | Davidson | 343/854 |

OTHER PUBLICATIONS

Blass; Multidirectional Antenna, IRE Nat. Conv. Record, Part 1, 1960.

*Primary Examiner*—Eli Lieberman

*Attorney, Agent, or Firm*—E. A. Onders; F. R. Agovino

[57] ABSTRACT

An array antenna for radiating wave energy signals into a selected region of space and suppressing radiation in other regions of space is formed with an aperture which is an array of N antenna element modules, each comprising two or more antenna element groups, and each group comprising one or more antenna elements. A plurality of 2N first transmission lines is provided, each for supplying wave energy signals to one of the element groups. The antenna also includes N second transmission lines. Each of the second transmission lines has an input terminal, intersects a selected number of first transmission lines, and is terminated at its other end. Directional couplers are provided for coupling the second transmission lines to the intersected first transmission lines. The directional couplers have selected coupling amplitudes and coupling phases to cause signals supplied to any of the input terminals to be coupled primarily to the elements of the element module corresponding to the input terminal, and to be coupled with selected relative amplitudes and phases to selected elements in other element modules of the array.

10 Claims, 7 Drawing Figures

ARRAY ANTENNA SYSTEM

BACKGROUND OF THE INVENTION

The present invention relates to array antennas and particularly to antennas designed to radiate within a limited angular region of space.

In their U.S. Pat. No. 4,041,501 Frazita, et al. describe a limited scan array antenna system with a sharp cut-off of the element pattern. In accordance with the Frazita disclosure there is provided a coupling network for interconnecting the input terminals of a plurality of antenna element modules and the corresponding antenna elements of each module. In addition, the network interconnects the element modules so that signals supplied to any of the input terminals are supplied primarily to the elements of the corresponding element module, and also supplied to selected elements in other element modules of the array. As a result of this selective coupling, the antenna aperture can be provided with an aperture excitation corresponding approximately to a sine x/x element distribution for input signals supplied to any of the input terminals of the coupling network. Accordingly, supplying wave energy signals to any one of the input terminals causes the antenna array to radiate an effective pattern which corresponds to the radiation pattern approximately radiated by a sine x/x aperture distribution, that is, an element pattern with a substantially uniform amplitude over a selected angular region of space, and effectively no radiation over remaining regions of space in which it is desired to suppress radiation. The effective element spacing of the array can be increased to the point where grating lobes, which might occur during the scanning of a radiation beam through the desired region of space are allowed to occur in regions of the antenna element pattern wherein antenna radiation is suppressed. As a result, a substantially larger effective element spacing can be used for a limited scan array antenna, and the number of active elements, for example, phase shifters, needed for the operation of the array antenna in a particular system, such as a microwave landing system, can be substantially reduced.

Another antenna system having a modular coupling network for effecting a similar control of element radiation pattern has been described in the pending application of Harold Wheeler, U.S. Pat. No. 4,143,379 issued Mar. 6, 1979. While both of these prior art systems, and particularly the Frazita et al. patent, describe systems which are capable of providing effective control of an antenna element pattern in order to achieve an element pattern which permits a larger effective element spacing with a consequent savings in antenna control components for a limited scan antenna; these prior art systems are most useful over only a limited frequency band, as is the case for the apparatus described in the Frazita patent, or may involve a complex network of interconnections, as in the apparatus described in the Wheeler patent.

It is an object of the present invention to provide an array antenna system having control of antenna element pattern in order to effectuate the element pattern control and cost savings of the aforementioned patent and application, wherein there is provided a simplified coupling network, which is operable over a relatively large frequency band.

SUMMARY OF THE INVENTION

In accordance with the present invention there is provided an array antenna comprising an array antenna aperture having a plurality of N antenna element modules, each module comprising A antenna element groups wherein A is an integer greater than 1, each antenna element group comprising one or more antenna elements. The element modules and element groups are arranged along a predetermined path. There is also provided a plurality of AN first transmission lines where N is a positive integer, one associated with each of said antenna element groups, for supplying wave energy signals to the elements of the element group. There is also provided a plurality of N second transmission lines, one associated with each of the antenna element modules. Each of the second transmission lines has an input terminal, and each of the second transmission lines intersects a selected number less than AN of the first transmission lines for supplying wave energy signals to said associated module and modules adjacent to said associated module. There is provided a plurality of N sets of directional couplers, each set having said selected number of couplers and corresponding couplers of the N sets being substantially identical. Each set of couplers is for coupling one of the N second transmission lines to the intersected first transmission lines, and each of the directional couplers has a selected coupling amplitude and coupling phase to cause signals supplied to any of the first input terminals to be coupled primarily to the element groups of an element module corresponding to the input terminal, and also to be coupled with selected relative amplitude and phase to selected elements in other groups of the array.

In a preferred embodiment of the antenna, the elements are arranged along a predetermined path which is a straight line. The wave energy signals which are supplied to the input terminals of the second transmission lines may be provided with varying amplitude thereby to cause the antenna to radiate a radiation pattern having an angular frequency variation. Alternatively, the wave energy signals may have a varying phase, and thereby to cause the antenna to have a time varying angular radiation pattern.

In one preferred embodiment, the first and second transmission lines are arranged so that wave energy signals are coupled from each of the input terminals to the antenna element groups with equal phase length of transmission and the selected amplitude and phase of the sets of couplers causes an approximately sine x/x aperture excitation to be provided to the antenna elements in response to signals supplied to any of the input terminals. The center-to-center spacing between the adjacent antenna element modules in the array may be equal, and this spacing corresponds to the effective element spacing of the array. In this case, the relative amplitudes and phases are selected to radiate an effective element pattern which suppresses grating lobes for the selected effective element spacing and radiation region of the array. In a preferred arrangement, the transmission lines can be fabricated using microstrip techniques, and the transmission lines can intersect at directional couplers, which can be formed as branch line directional couplers out of the microstrip transmission line.

In a preferred arrangement, the array antenna is formulated out of coupling modules each of which is arranged to be connected to similar antenna modules to form a coupling network wherein there is provided a plurality of AN first transmission lines wherein A is an integer greater than 1 and N is a positive integer, each connected to one of a plurality of antenna element terminals at one end and terminated at the opposite end, and a plurality of N second transmission lines intersecting and selectively coupled to a selected number less than AN of the first transmission lines and terminated at the opposite end. The coupling module comprises an input terminal, A antenna element terminals, a plurality of directional couplers, equal in number to the maximum number of first transmission lines coupled to any one of said second transmission lines, and cross coupling ports, the couplers have directional coupling coefficients selected to operate collectively in the network and to cause the signal supplied to the input terminal to be coupled primarily to the A element terminals of the element module and to be coupled with selected relative amplitude and phase to selected other element terminals in other element modules of the array.

For a better understanding of the present invention, together with other and further objects, reference is made to the following description, taken in conjunction with the accompanying drawings, and its scope will be pointed out in the appended claims.

DESCRIPTION OF THE INVENTION

Figure 1A:
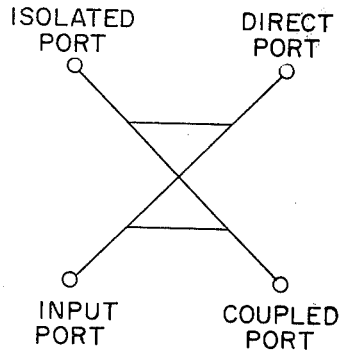
FIG. 1A is a schematic diagram of a directional coupler, indicating the convention used in the FIG. 1 diagram.
Figure 1:
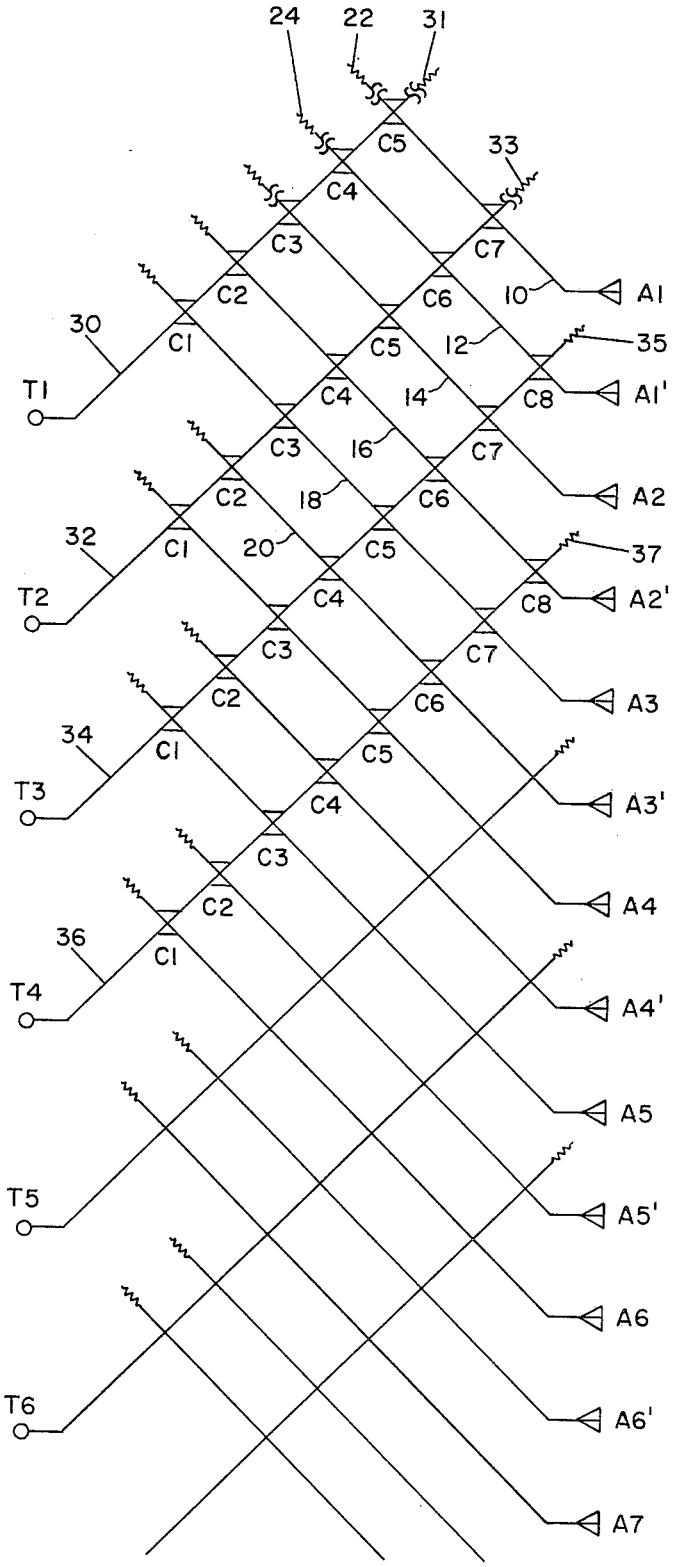
FIG. 1 is a schematic diagram showing an array antenna in accordance with the present invention.

In the FIG. 1 antenna there is provided an aperture which consists of a plurality of antenna element modules. Each module comprises A two antenna element groups where A is an integer greater than 1. In the FIG. 1 embodiment, each module comprises two antenna element groups (A=2). Each of the groups in the FIG. 1 antenna is illustrated to have only a single antenna element, but as indicated in the above-referenced Frazita patent, the antenna element groups may each comprise one or more antenna elements. The antenna elements, which are used in an array antenna of the type illustrated schematically in FIG. 1, are typically dipole antennas, waveguide openings, slots or similar small radiators. In the embodiment shown the antenna elements are arranged along a straight line to form an aperture comprising a linear array of antenna elements. The teachings and scope of the present invention are not necessarily limited to such linear arrays of antenna elements, but may also be applied to arrays which comprise antenna elements arranged along a path other than a straight line, for example, the arc of a circle, and also may apply to antenna elements arranged within a plane and capable of scanning in one or more angular directions with respect to that plane.

In the FIG. 1 diagram, the first antenna element module comprises elements A1 and A1', the second antenna module comprises elements A2 and A2', the third antenna element module comprises antenna elements A3 and A3', and so forth. For each of the antenna elements in the FIG. 1 array there is provided a first transmission line connected to that element and having its opposite end terminated in a resistive load. Thus, there is provided transmission line 10, which is connected at one end to antenna element A1, and connected at an opposite end to a resistive load 22. Likewise transmission line 12 is connected between antenna element A1' and resistive load 24, and transmission lines 14, 16, 18 and 20 are likewise connected to respective antenna elements A2, A2', A3, A3' and have respective terminating resistive loads. As is evident from an examination of the schematic diagram of FIG. 1, there are provided a plurality of second transmission lines, one corresponding to each of the antenna element modules, which intersect said first transmission lines. Thus, there is provided a transmission line 30 which corresponds to the antenna element module consisting of antenna elements A1 and A1'. Transmission line 30 has an input terminal T1 and has its opposite end connected in a resistive load 31. Likewise additional second transmission lines 32, 34 and 36 interconnect respective input terminals T2, T3 and T4 and corresponding resistive loads 33, 35 and 37. Each of the second transmission lines is selectively coupled to the intersected first transmission lines as illustrated in FIG. 1. A schematic explanation of the convention used for the directional couplers in the FIG. 1 drawing is shown in FIG. 1A. Thus, each of transmission lines 30, 32, 34 is coupled by a corresponding set of directional couplers (C1–C5 for line 30; C1–C7 for line 32; and C1–C8 for line 34) to the intersected first transmission lines.

Figure 3:
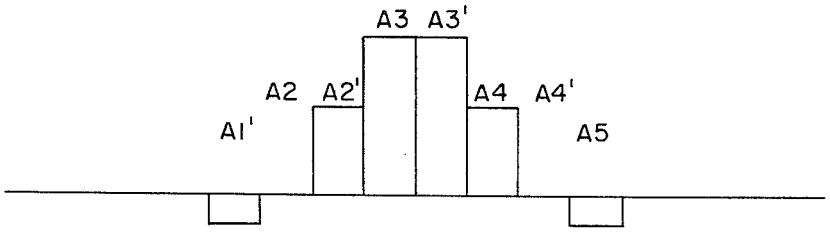
FIG. 3 illustrates a possible aperture excitation available in accordance with the present invention.

Each of the couplers C1 through C8 has an amplitude of coupling and a coupling phase which is selected so that signals supplied to any of the input terminals T1, T2, T3 are supplied to the elements of the array with selected amplitude and phase. In accordance with the present invention, each set of corresponding couplers C1 through C8 is substantially identical. The sets of couplers are chosen so that signals supplied to an input terminal, for example input terminal T3, are primarily supplied to a corresponding pair of antenna elements A3, A3' (comprising an element module), and are also supplied to selected other elements in the array with amplitudes and phases to provide an element aperture excitation which corresponds approximately to a sine x/x aperture distribution. As has been described with respect to the above-referenced patent and copending application, this type of element amplitude distribution on the aperture results in a radiated element pattern which corresponds largely to radiation of uniform amplitude within a selected desired angular region of space wherein the antenna is to operate and radiation of substantially lower amplitude in other regions of space, for example, those regions wherein a grating lobe of the array might occur. A suitable element aperture excitation for signals supplied to terminal T3 of the array shown in FIG. 1 are shown in FIG. 3 wherein elements A3 and A3' have a signal amplitude of unity, elements A2' and A4 have an element signal amplitude of 0.5, and elements A1' and A5 have an element signal amplitude of −0.2. No signals are supplied to elements A2 and A4'. The following coupling coefficients for couplers C1 through C8 can give the appropriate element amplitude pattern shown in FIG. 3, with equal spacing of the couplers along the first and second transmission lines.

| | |
|---|---|
| $C_1 = -.1776$ | $C_5 = .8000$ |
| $C_2 = -.1377$ | $C_6 = .3936$ |
| $C_3 = .2610$ | $C_7 = .0000$ |
| $C_4 = .7304$ | $C_8 = -.2901$ |

It should be recognized that for some elements the path from the input terminal to the element may follow several directions, and consequently the computation of coupling values for a particular desired element aperture excitation is preferably made with the assistance of a digital computer.

The set of coupling values given above is suitable for use in an array antenna designed to steer an antenna beam within a ±5° angular region of space without grating lobes. The element modules of such an array may be spaced by as much as two wavelengths, and the effective element pattern which results from the excitation illustrated in FIG. 3 will suppress grating lobes.

Another set of coupling values, which gives a similar aperture amplitude excitation wherein the element values are A3=A3′=1.0, A2′=A4=0.53, A1′=A5=−0.23, A2=A4′=0 is:

| | |
|---|---|
| $C_1 = -.118$ | $C_5 = .581$ |
| $C_2 = -.045$ | $C_6 = .300$ |
| $C_3 = .251$ | $C_7 = 0$ |
| $C_4 = .557$ | $C_8 = -.150$ |

An important characteristic of the present invention is that the paths through the network from any input terminal T to the antenna elements coupled to that terminal have approximately equal transmission line length. This fact minimizes the variation of insertion phase through the network with variation in operating frequency. As a result, the array of the present invention is capable of operating with high performance over a relatively broad range of frequencies.

Those skilled in the art will recognize that it is possible to provide other and more extensive aperture amplitude excitations in response to a signal input to one of the input terminals shown in FIG. 1 by providing further extended first and second sets of transmission lines and additional couplers in each of the sets of couplers provided in the array.

Figure 4:
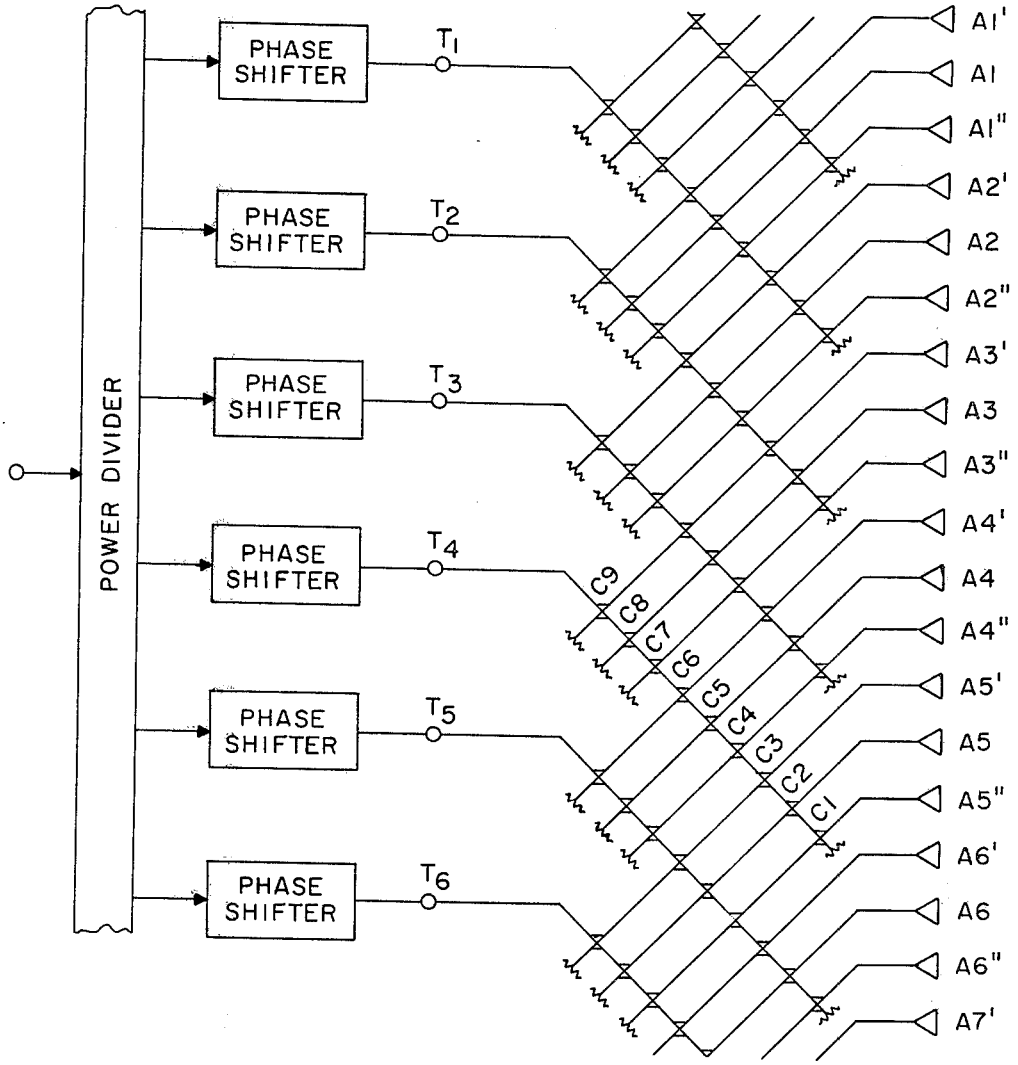
FIG. 4 illustrates another embodiment of an array antenna in accordance with the present invention.
Figure 5:
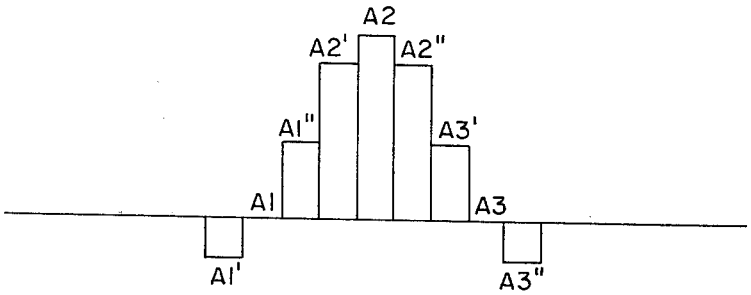
FIG. 5 illustrates a possible aperture excitation for the array of FIG. 4.

For example, in the array shown in FIG. 4 each of the antenna modules comprises three antenna element groups (A=3), with each group comprising one element. Correspondingly, the signal supplied to each of the input terminals (T1, T2, T3, etc.) is coupled primarily to the three antenna element groups which correspond thereto, and secondarily to elements in other selected groups in the array for providing the desired aperture excitations shown in FIG. 5 and indicated below:

A3=1
A3′=A3″=0.83
A2″=A4′=0.41
A2=A4=0
A2′=A4″−−0.21

In the embodiment of FIG. 4, the coupling values for the sets of directional couplers C1 through C9 are as set forth below:

| | |
|---|---|
| C1 = −0.310 | C6 = 0.577 |
| C2 = 0 | C7 = 0.228 |
| C3 = 0.518 | C8 = −0.092 |
| C4 = 0.650 | C9 = −0.163 |
| C5 = 0.693 | |

As in the case of the earlier patent of Frazita et al., the type of array antenna illustrated in FIG. 1 may be used in connection with a signal generator and phase shifting circuit in order to provide an antenna beam which is electronically steerable by variation of the distribution of the set of signals supplied to each of the input terminals T1, T2, T3, etc. Alternatively, it is possible to provide what is commonly known as a Doppler system by providing a variation in the amplitude of the signal with time for each of the input terminals. Thus, if input signals are sequentially supplied to the terminals T1, T2, T3, T4, etc., the antenna aperture will radiate an antenna pattern which has a frequency which varies with angular position in space.

While the antenna illustrated schematically in FIG. 1 contemplates only beam scanning or other active variation of antenna pattern in one angular coordinate in space, those skilled in the art and familiar with such phased array antennas will recognize that a plurality of the arrays of the type shown in FIG. 1 may be arranged side by side (in a direction perpendicular to the paper, for example) in order to thereby form a planar array of antenna elements. The principles applicable to the linear array shown in FIG. 1 will be equally applicable to the planar array, with the addition of further coupling networks interconnecting the input terminals of each of the networks for the linear arrays of antenna elements. In accordance with another variation of the array shown in FIG. 1, which was also shown in the prior application of Frazita et al. referred to above, it is possible to provide a plurality of antenna elements for each of the antenna element positions A1, A1′, A2, A2′ shown in the linear array of FIG. 1. This plurality of antenna elements may be used, for example, to shape the element pattern in the direction of the angular coordinate which is perpendicular to the line along which the elements A1, A1′, A2, A2′ etc. are arranged.

Figure 2:
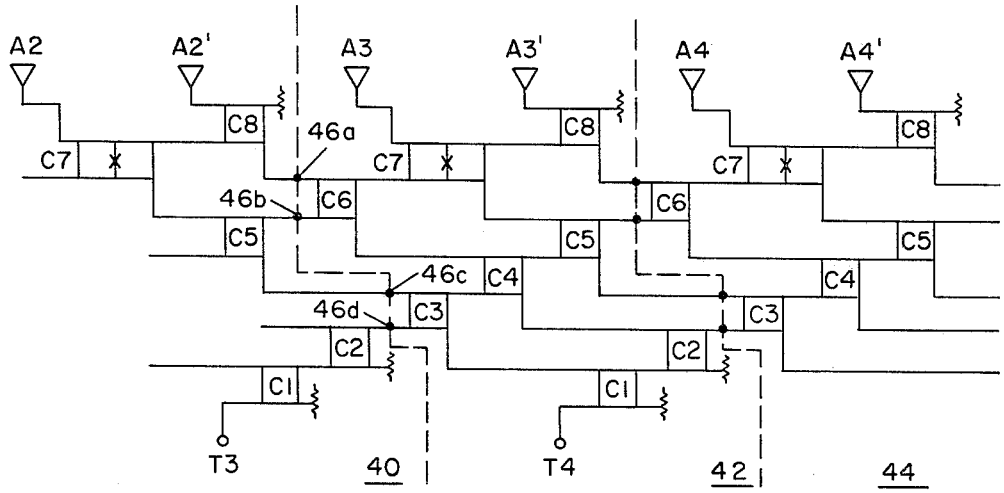
FIG. 2 illustrates a microstrip embodiment of the array antenna of the present invention.

FIG. 2 illustrates an embodiment of the FIG. 1 array wherein the transmission lines and couplers are formed from a single layer of microstrip transmission line. Further, the couplers in the coupling network shown in FIG. 2 are arranged into coupling modules 40, 42, 44 so that each of the input terminals T has a corresponding set of antennas A and A′ and a set of intermediate couplers, all of which can be formed on a single printed circuit board of microstrip or strip-line transmission line. Further, the microstrip transmission lines used in each of the element modules 40, 42, 44 of the FIG. 2 antenna are identical and therefore may be printed and connected together side by side using cross-coupling ports 46*a*, 46*b*, 46*c*, 46*d* to form a complete coupling network for the array. Alternately, by using repetitive printing techniques, the entire coupling network may be printed on a single large printed circuit board.

Figure 2A:
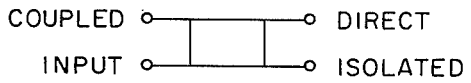
FIG. 2A indicates the operation of the microstrip couplers used in the FIG. 2 embodiment.

The schematic diagram of FIG. 1 makes it easy to recognize the presence of the first set of transmission lines, each connected to an antenna element, and the second set of transmission lines, each connected to an input terminal. In the FIG. 2 embodiment it is more difficult to visualize the first and second sets of transmission lines, because the transmission lines traverse each of the directional couplers used in the microstrip circuit in a diagonal direction. It is noted that couplers C7 in the array illustrated in FIG. 2 are "zero dB." couplers; that is, the lines which cross at coupler C7 do not couple to each other. Accordingly, the coupling value set forth in the table above for coupler C7 is zero. FIG. 2A illustrates the schematic arrangement for the couplers which are illustrated in the FIG. 2 embodiment of the antenna.

It should be recognized by those skilled in the art that the embodiments of array excitations and coupling values set forth herein are set forth for example only and not to limit the claims of the invention. As mentioned above, it is within the normal skill of those familiar with the art that such coupling values can be determined by the use of a digital computer, given the relative amplitudes and phases of the coupling signals which are to be supplied to each of the antenna elements in the array from any of the input terminals of the array.

The array antennas of the present invention have been described primarily from the point of view of a transmitting antenna wherein signals are supplied to the input terminals T of the array and radiated from the antenna elements. Those skilled in the art recognize that such antennas are fully reciprocal, and that signals supplied from space to the antenna elements will be coupled to the terminals T of the array in an antenna pattern of response which is identical to the radiation pattern of the antenna. Accordingly, the claims of this application shall be construed to cover receiving as well as transmitting antennas.

While there have been described what are believed to be the preferred embodiments of the present invention, those skilled in the art will recognize that other and further modifications may be made thereto without departing from the spirit of the invention, and it is intended to claim all such embodiments as fall within the true scope of the invention.

I claim:

1. An array antenna, comprising an antenna aperture comprising a plurality of N antenna element modules where N is a positive integer, each module comprising A antenna element groups where A is an integer greater than 1, each antenna element group comprising one or more antenna elements, said element modules and element groups being arranged along a predetermined path;

a plurality of AN first transmission lines, one associated with each of said antenna element groups, for supplying wave energy signals to the elements of said element groups;

a plurality of N second transmission lines, one associated with each of said antenna element modules, each of said second transmission lines having an input terminal and each of said second transmission lines intersecting a selected number less than AN of said first transmission lines for supplying wave energy signals to said associated module and modules adjacent to said associated module;

a plurality of N sets of directional couplers, each set having said selected number of couplers and, corresponding couplers of said N sets being substantially identical, each set for coupling one of said N second transmission lines to said intersected first transmission lines, and each of said directional couplers having a selected coupling amplitude and coupling phase to cause signals supplied to any of said input terminals to be coupled primarily to the element groups of an element module corresponding to said input terminal and to be coupled with selected relative amplitude and phase to selected elements in other element groups of said array.

2. An array antenna as specified in claim 1 wherein said predetermined path is a straight line.

3. An array antenna as specified in claim 1, further comprising means for supplying wave energy signals to said input terminals including means for supplying amplitude varying signals to said terminals thereby to cause said antenna to radiate a radiation pattern having an angular frequency variation.

4. An array antenna as specified in claim 1 further comprising means for supplying wave energy signals to said input terminals including means for supplying phase varying signals to said terminals thereby to cause said antenna to radiate a radiation pattern with time varying angular position.

5. An array antenna as specified in claim 1 wherein said first and second transmission lines and said couplers are arranged to provide approximately equal transmission line lengths between each of said input ports and its coupled antenna elements.

6. An array antenna as specified in claim 1 wherein said selected amplitude and phase approximates a sine x/x aperture excitation.

7. An array antenna as specified in claim 1 wherein the spacing between adjacent antenna element modules is equal and said spacing comprises the effective element spacing of said array, and wherein said relative amplitudes and phases are selected to radiate an effective element pattern which suppresses grating lobes for said effective element spacing.

8. An array antenna as specified in claim 1 wherein said first and second transmission lines comprise microstrip transmission lines, and wherein said transmission lines intersect at said directional couplers, and wherein said directional couplers comprise branch line couplers.

9. An array antenna as specified in claim 1 wherein A=2.

10. An array antenna as specified in claim 1 wherein A=3.

* * * * *